US005971510A

United States Patent [19]

Lickiss et al.

[11] Patent Number: 5,971,510

[45] Date of Patent: Oct. 26, 1999

[54] APPLIANCE CONSOLE ATTACHMENT

[75] Inventors: Chris P. Lickiss; Daryl A. Michael, both of Newton, Iowa

[73] Assignee: Maytag Corporation, Newton, Iowa

[21] Appl. No.: 09/010,664

[22] Filed: Jan. 22, 1998

[51] Int. Cl.[6] ..... A47B 47/00

[52] U.S. Cl. ..... 312/263; 312/228; 312/293.1

[58] Field of Search ..... 312/223.1, 228, 312/257.1, 263, 265.5, 265.6, 248, 279, 293.1, 293.2, 293.3, 140.4; 220/4.02; 403/252, 256, 257, 261, 263

[56] References Cited

U.S. PATENT DOCUMENTS

| | | | |
|---|---|---|---|
| 4,003,613 | 1/1977 | Oakley . | |
| 4,288,133 | 9/1981 | Deatherage | 312/279 |
| 4,765,698 | 8/1988 | Dooley | 312/248 |
| 4,798,425 | 1/1989 | Coates et al. | 312/257 R |
| 4,840,285 | 6/1989 | Carr . | |
| 5,350,140 | 9/1994 | Ripley et al. | 248/27.1 |
| 5,358,323 | 10/1994 | Ripley | 312/228 |
| 5,611,609 | 3/1997 | Katz et al. | 312/263 |
| 5,611,610 | 3/1997 | Katz et al. | 312/263 |
| 5,685,623 | 11/1997 | Katz et al. | 312/263 |

*Primary Examiner*—Eric K. Nicholson
*Assistant Examiner*—Brian H. Buck
*Attorney, Agent, or Firm*—Zarley, McKee, Thomte, Voorhees & Sease

[57] ABSTRACT

An appliance console is provided, wherein the console is quickly and easily mounted on the appliance without the use of mounting hardware or tools. The console includes pairs of front and rear feet which are adapted to be received within corresponding slots in the top cover of the cabinet. In mounting the console to the appliance cabinet, the console is tilted forwardly with the front feet extending into the front slots. The console is then rotated rearwardly such that the rear feet extend into the rear slots. The length of the slots is substantially the same as the width of the feet, such that the console is substantially free from forward and rearward movement relative to the top cover of the cabinet. A back plate is connected to the back of the console and the back of the appliance to provide enhanced structural integrity and security to the mounted console.

12 Claims, 3 Drawing Sheets

APPLIANCE CONSOLE ATTACHMENT

BACKGROUND OF THE INVENTION

Household appliances, such as a clothes washing machine or a clothes dryer, normally have a cabinet with a control console mounted on top of the cabinet. Prior art consoles conventionally are mounted to the top of the cabinet with hardware, including screws. For ease of installation, the screws are often times located on the front of the console, and thus are visible to a person using the appliance. Such prior art mounting hardware adds to the cost of the appliance due to the materials and labor required for mounting the console onto the cabinet. The mounting hardware is also unsightly if located on the front of the console.

Accordingly, a primary objective of the present invention is the provision of a console which is mounted to an appliance without the use of hardware.

A further objective of the present invention is the provision of a console which is quickly and easily attached to the top of an appliance.

Another objective of the present invention is the provision of a console which can be mounted to an appliance without the use of tools.

A further objective of the present invention is the provision of a console having downwardly extending feet adapted to be received in corresponding slots in the top cover of the cabinet such that the console is substantially free from forward and rearward movement relative to the top cover of the cabinet.

These and other objectives will become apparent from the following description of the invention.

SUMMARY OF THE INVENTION

The appliance console of the present invention includes at least a pair of front and rear downwardly extending feet at opposite ends of the console. The feet are adapted to be received in slots in the top cover of the appliance cabinet so as to mount the console to the top cover of the cabinet without mounting hardware or the use of tools.

In mounting the console to the top cover of the cabinet, the console is tilted forwardly and the front feet are inserted into the corresponding slots in the top cover of the cabinet. The console is then rotated rearwardly such that the rear feet are received into the rearward slots on the top cover of the cabinet. Once the console is fully rotated rearwardly such that the bottom of the console engages the top cover of the cabinet, there is substantially no forward or rearward movement of the console relative to the cabinet, since the length of the slots is substantially the same as the width of the feet. A back plate may be attached between the back of the console and the back of the appliance using mounting screws, to provide additional security and integrity. The screws for the back plate are not visible from the front of the appliance.

DETAILED DESCRIPTION OF THE DRAWINGS

Figure 1:
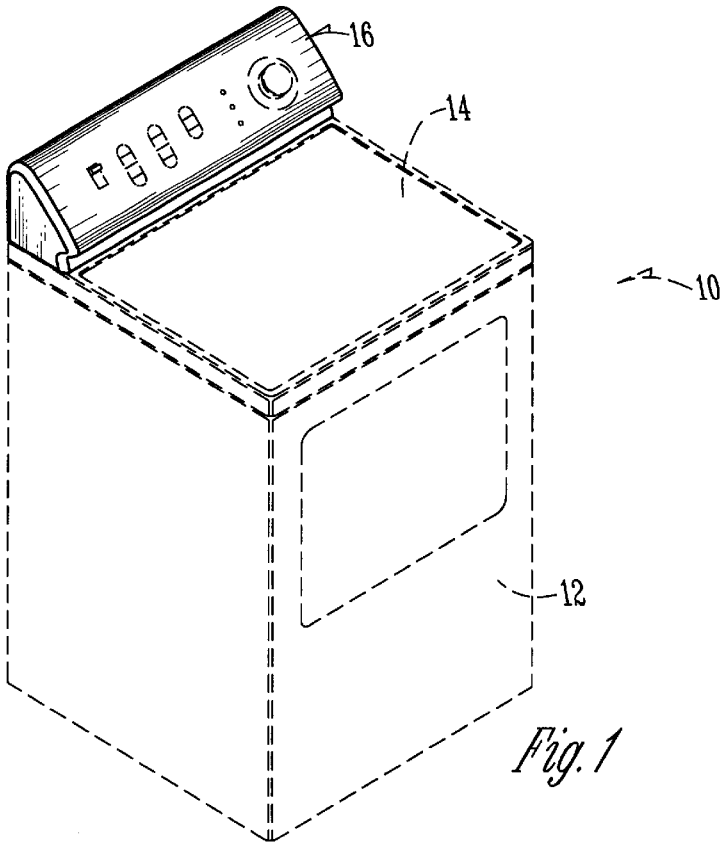
FIG. 1 is a perspective view of an appliance with the console of the present invention.

As seen in the drawings, an appliance, such as a clothes dryer 10, generally includes a cabinet 12 with a top cover 14. A console 16 having control indicia for operating the appliance is mounted on the top cover 14 of the cabinet 12. Preferably, the console 16 is manufactured as a unitary body.

The console 16 includes a front 18, a back 20, a top 22, and a bottom 24. Extending downwardly from the bottom 24 of the console 16 are a pair of front feet 26 and a pair of rear feet 28. The front and rear feet 26, 28 preferably are located at the opposite ends of the console 16, and are adapted to be received in corresponding front and rear slots 30, 31 in the top cover 14 of the cabinet 12. Although not shown, a third pair of feet 26, 28 are located at the center of the console 16.

More particularly, each of the feet 26, 28 includes a forwardly disposed recess 32 adapted to engage the forward ends 34, 35 of the respective slot 30, 31. The rear or heel portion 36 of each foot 26, 28 is sloped so as to permit the foot 26, 28 to pass into the slot 30, 31. The forward portion of at least the rear feet 28 includes a ramped surface 38 which facilitates removal of the console 16 from the top cover 14 of the cabinet 12.

Figure 2:
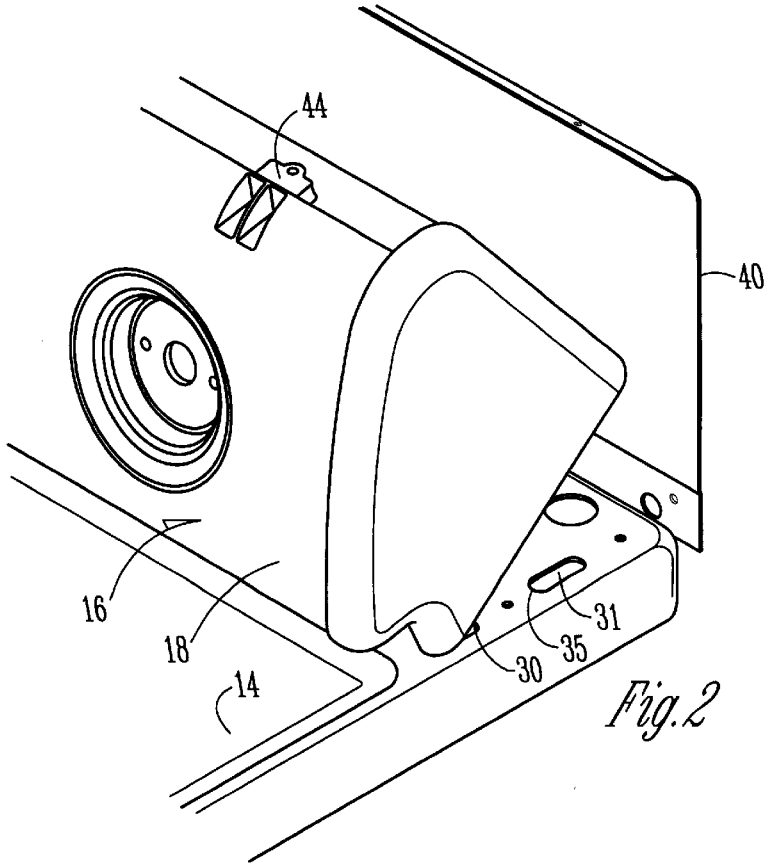
FIG. 2 is a partial perspective view showing the position of the console relative to the top of the cabinet at the beginning of the console mounting process.
Figure 3:
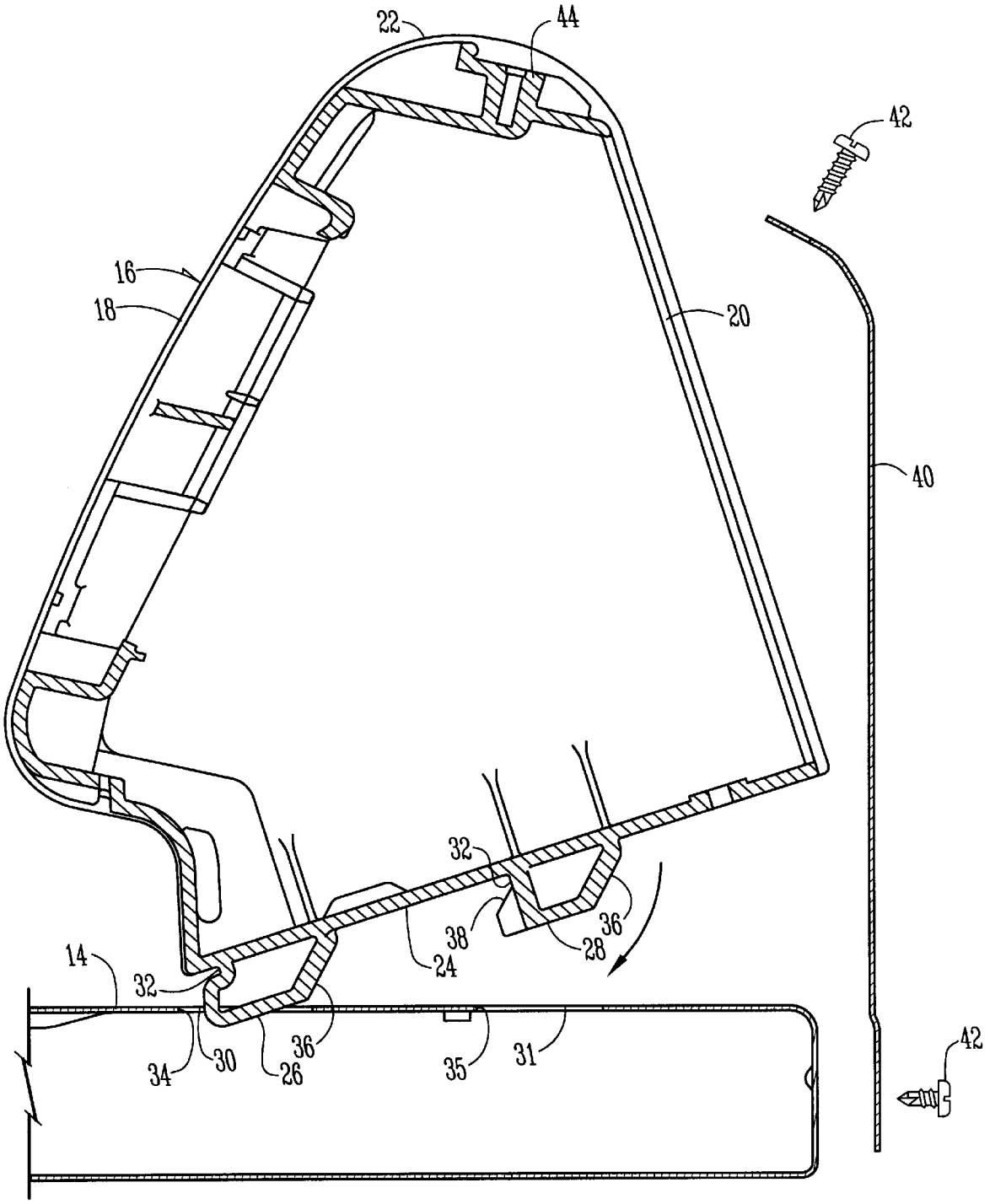
FIG. 3 is an enlarged side sectional view showing the initial mounting position of the console relative to the cabinet.
Figure 4:
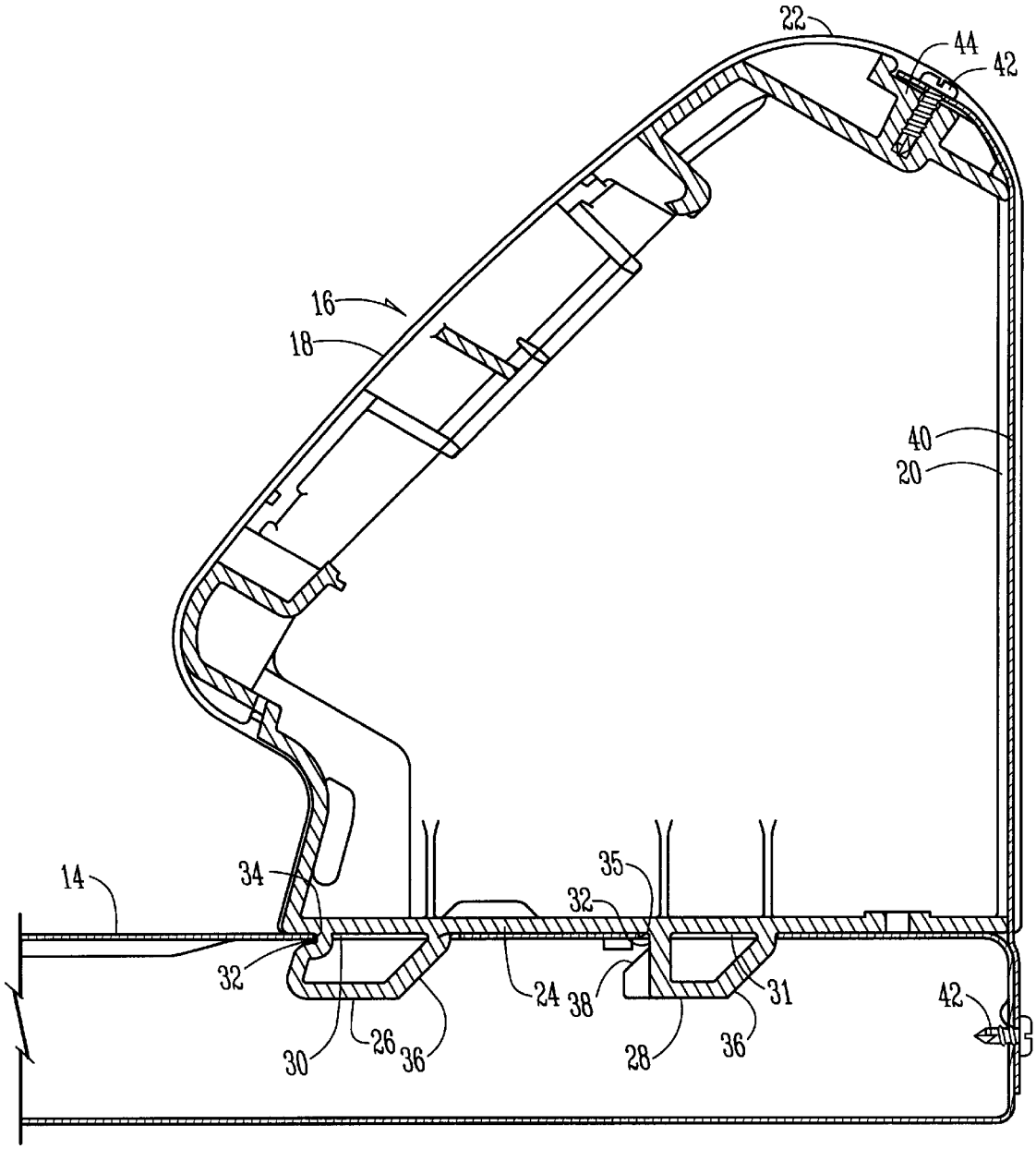
FIG. 4 is a side sectional view showing the console fully mounted to the cabinet with a back plate secured thereto.

The lower front corner of the console 16 is spaced closely to the front feet 26, thereby allowing the console 16 to be tilted forwardly, as shown in FIGS. 2 and 3, while the front feet 26 are inserted into the front slots 30. The console 16 is then rotated rearwardly such that the rear feet 28 extend through the rear slots 31, until the bottom 24 of the console 16 engages the top cover 14 of the cabinet 12, as seen in FIG. 4. As further shown in FIG. 4, the length of the slot 30 is only slightly larger than the width of the foot 26 such that the console 16 is substantially free from forward and rearward movement when mounted on the top cover 14 of the cabinet 12. Thus, the console 16 is mounted on the cabinet 12 without the use of hardware, such as screws, and without the use of tools.

A back plate 40 is mounted to the back 20 of the console 16 and the back of the top cover 14 using screws 42. The back 20 of the console 16 includes bosses 44 at opposite ends and at the center (not shown) of the console 16 for receiving the screws 42. The back plate 40 provides additional structural security and integrity to the assembled console and cabinet.

If it is necessary to remove the console 16 from the cabinet 12, the top screws 42 are removed and the back plate 40 can remain attached to the top cover 14. Then, the console 16 is rotated forwardly such that the rear feet 28 disengage from the rear slots 31. The ramped surface 38 on the front of the rear feet 28 slide upon the forward ends 35 of the slots 31, thereby urging the console 16 slightly rearwardly relative to the top cover 14, such that the front feet 26 are more easily disengaged from the slots 30 and preventing binding and possible breakage of the front feet 26.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A console for an appliance having a cabinet with a top cover, comprising:

a body having a front surface;

a pair of front feet and a pair of rear feet extending downwardly from the body;

the front feet being adapted to fit through front slots in the top cover of the appliance, such that the body is rotatable in a rearward direction and the rear feet fit through rear slots in the top cover, thereby mounting the console on the top cover; and the front surface of the body requiring no connecting hardware for the connection of the front surface to the top cover.

2. The console of claim 1 wherein the body has a lower front edge spaced closely to the front feet to permit the body to be tilted forwardly while the front feet are inserted through the front slots.

3. The console of claim 1 wherein the rear feet include a forwardly disposed ramp for directing the body rearwardly when the body is rotated forwardly for disengagement from the top cover.

4. The console of claim 1 wherein the body has a unitary construction.

5. The console of claim 1 wherein the front and rear feet are adjacent opposite ends of the body.

6. The console of claim 1 wherein each of the front feet include a forwardly disposed recess for receiving a forward portion of the front slot.

7. The console of claim 1 wherein the front and rear feet are received in the front and rear slots, respectively, such that the body is substantially free from forward and rearward movement relative to the top cover.

8. The console of claim 1 wherein the front and rear feet each have an upwardly and rearwardly sloped surface to permit rearward rotation of the feet into the respective slots.

9. The console of claim 1 wherein the body further includes opposite end surfaces, the front surface and end surface having a one-piece construction.

10. A console for an appliance having a cabinet with a top cover, comprising:

a body having a front surface;

a pair of front feet and a pair of rear feet extending downwardly from the body;

the front feet being adapted to fit through front slots in the top cover of the appliance, such that the body is rotatable in a rearward direction and the rear feet fit through rear slots in the top cover, thereby mounting the console on the top cover; and the rear feet including a forwardly disposed ramp for directing the body rearwardly when the body is rotated forwardly for disengagement from the top cover.

11. The console of claim 10 wherein the front surface of the body has no connecting hardware.

12. A console for an appliance having a cabinet with a top cover, comprising:

a body having a front surface;

a pair of front feet and a pair of rear feet extending downwardly from the body;

the front feet being adapted to fit through front slots in the top cover of the appliance, such that the body is rotatable in a rearward direction and the rear feet fit through rear slots in the top cover, thereby mounting the console on the top cover; and each of the front feet including a forwardly disposed recess for receiving a forward portion of the front slot.

* * * * *